US006679082B1

(12) United States Patent
Tunzi

(10) Patent No.: US 6,679,082 B1
(45) Date of Patent: Jan. 20, 2004

(54) NO WELL DISPENSING ASSEMBLY FOR A REFRIGERATOR

(75) Inventor: Todd J. Tunzi, Amana, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/351,406

(22) Filed: Jan. 27, 2003

(51) Int. Cl.[7] ..... F25C 5/18
(52) U.S. Cl. ..... 62/344; 62/377; 62/389
(58) Field of Search ..... 62/344, 340, 353, 62/377, 389; 193/2 R; 222/146.6

(56) References Cited

U.S. PATENT DOCUMENTS

| | | | | |
|---|---|---|---|---|
| 2,512,395 A | | 6/1950 | Sundberg | |
| 3,747,363 A | | 7/1973 | Grimm | |
| 3,942,334 A | * | 3/1976 | Pink | 62/266 |
| 3,969,909 A | * | 7/1976 | Barto et al. | 62/179 |
| 4,209,999 A | | 7/1980 | Falk et al. | |
| 4,227,383 A | | 10/1980 | Horvay | |
| 4,651,789 A | * | 3/1987 | Linstromberg | 141/360 |
| 4,851,662 A | * | 7/1989 | Ott et al. | 250/214 AL |
| 5,077,985 A | | 1/1992 | Buchser et al. | |
| 5,148,842 A | * | 9/1992 | Boust | 141/98 |
| 5,211,462 A | | 5/1993 | Bien et al. | |
| 5,272,888 A | | 12/1993 | Fisher et al. | |
| 5,437,391 A | | 8/1995 | Landers et al. | |
| 5,473,911 A | * | 12/1995 | Unger | 62/344 |
| 5,886,430 A | * | 3/1999 | Ralson et al. | 307/126 |
| 6,158,564 A | * | 12/2000 | Derelanko | 193/2 R |
| 2003/0019236 A1 | * | 1/2003 | Heims et al. | 62/338 |

FOREIGN PATENT DOCUMENTS

| | | | |
|---|---|---|---|
| EP | 0 449061 A2 | * | 10/1991 |
| FR | 2738903 | | 3/1997 |

* cited by examiner

*Primary Examiner*—William E. Tapolcai
*Assistant Examiner*—Mohammad M. Ali
(74) *Attorney, Agent, or Firm*—Diederiks & Whitelaw, PLC

(57) ABSTRACT

A refrigerator includes a dispensing assembly having a service zone recessed in an outer portion of the freezer door, an ice passage formed in a freezer door, and a chute member arranged at the service zone. The ice passage is aligned with an outlet of an ice maker unit and leads to the service zone for delivering ice pieces from the ice maker unit to the service zone. Further, the chute member is movable between a first position, wherein ice pieces delivered from the ice maker are directed into the service zone, and a second position, wherein ice piece delivered from the ice maker are diverted away from the freezer door and outside of the service zone to enhance the filling of oversized containers. The dispensing assembly also includes a drip tray for collecting excess water droplets, with the drip tray being substantially hidden within the freezer door.

17 Claims, 5 Drawing Sheets

NO WELL DISPENSING ASSEMBLY FOR A REFRIGERATOR

BACKGROUND OF THE INVENTION

1. Field of the Invention

The present invention pertains to the art of refrigerators and, more particularly, to refrigerators having ice and water dispensing arrangements.

2. Discussion of the Prior Art

It is now common practice in the art of refrigerators to provide an automatic ice maker within a freezer compartment of a refrigerator and further to provide a system for dispensing the ice into a recessed receiving area formed in a front panel of the refrigerator. In essence, such a system provides for the automatic filling of an ice cube tray which is emptied into a bin following a freezing period. From the bin, the ice can be delivered to the receiving area by the selective activation of a drive unit, such as a rotatable auger located within the bin. The recessed receiving area formed in a front panel of the refrigerator includes a well for collecting excess ice and water droplets. Since the receiving area is recessed within the refrigerator door, the height of the receiving area limits the size of a glass or other container that may be filled by the ice maker.

In the industry, there have been various attempts to overcome this limitation. For example, U.S. Pat. No. 4,227,383 discloses a through-the-door ice service area having a pivoting cover member. When the cover is pivoted to an open position, an outlet opening is exposed so that ice pieces may flow freely into a container, which must be held below the cover member by a user. In another known system, as described in U.S. Pat. No. 2,512,395, a liquid dispensing apparatus for a refrigerator provides for liquid to be dispensed when a user pushes a container or glass against a forwardly projecting housing member. The forwardly projecting housing member pivots at a bottom end of the forwardly projecting housing member, thereby allowing a user to fill a large glass or container. One disadvantage of these ice delivery systems is that they do not provide drip trays for collecting excess ice or water droplets. This can lead to water puddles collecting in front of the refrigerator or to other problems within the dispensing system.

Based on the above, there exists a need in the art for an improved ice dispensing system having an ice service area which allows large containers to be easily filled, while still including a drip tray for collecting excess water droplets.

SUMMARY OF THE INVENTION

The present invention is directed to a refrigerator including a dispensing assembly. The dispensing assembly includes a service zone recessed in an outer portion of a freezer door of the refrigerator, an ice passage formed in the freezer door, and a chute member arranged at the service zone. The ice passage is aligned with an outlet of an ice maker unit and leads to the service zone for delivering ice pieces from the ice maker unit to the service zone. Further, the chute member is selectively movable between a first position, wherein ice pieces delivered from the ice maker are directed into the service zone, and a second position, wherein ice piece delivered from the ice maker are diverted away from the freezer door and outside of the service zone. The dispensing assembly also includes a drip tray for collecting excess water droplets at a bottom edge of the chute member. The drip tray is substantially hidden within the freezer door. With this overall arrangement, large glasses, buckets and the like may be filled with water or ice without size limitations.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
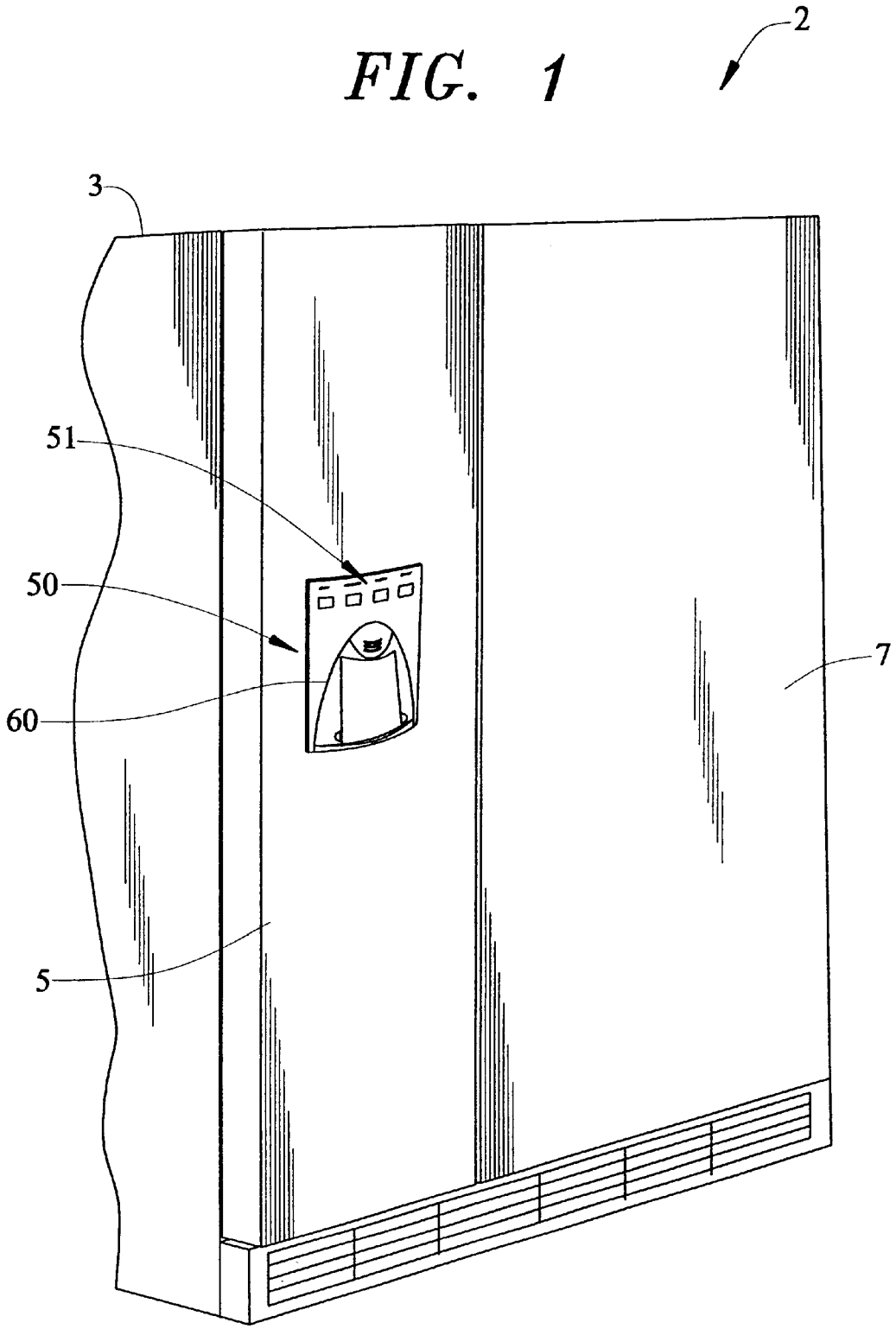
FIG. 1 is a perspective view of a side-by-side-refrigerator incorporating the dispensing assembly of the present invention.
Figure 2:
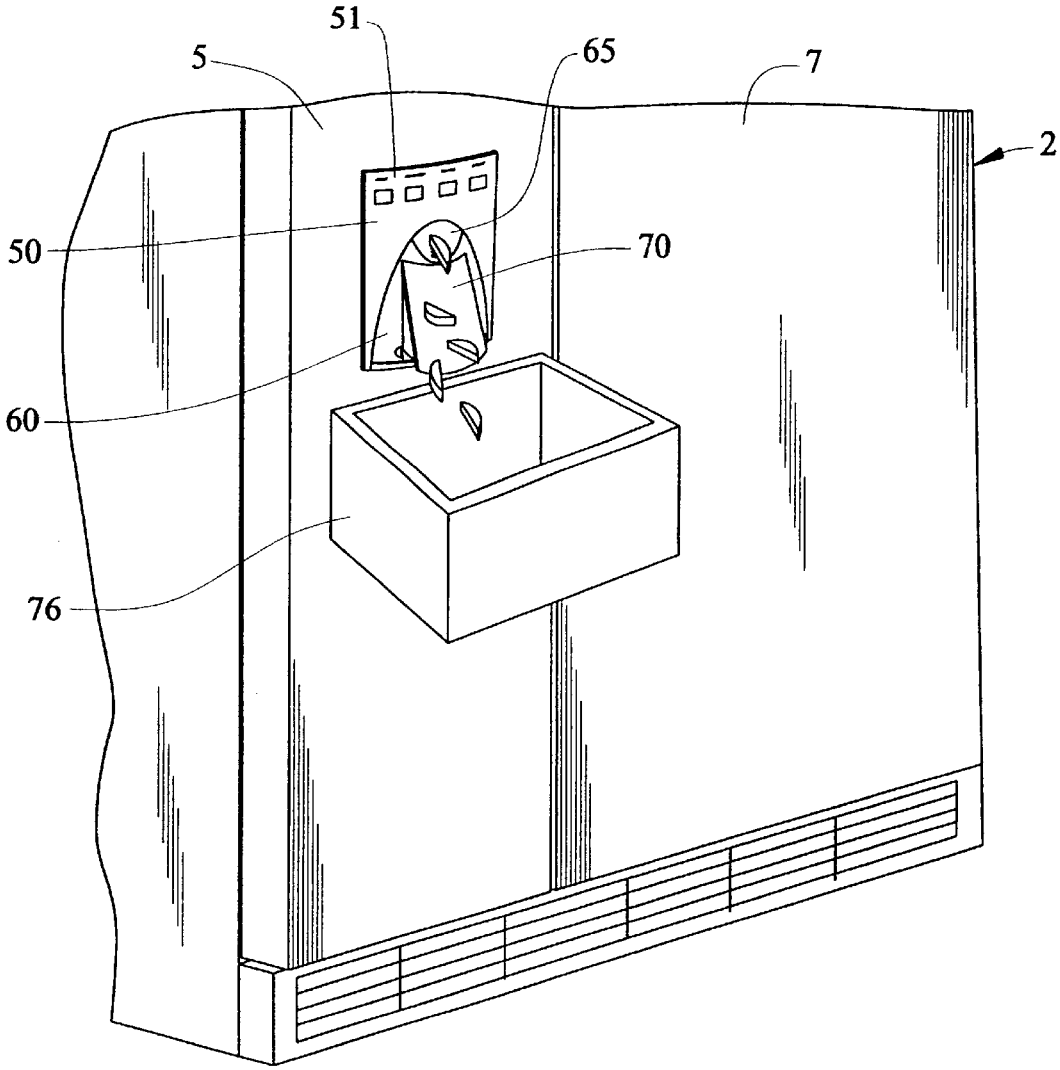
FIG. 2 shows the dispensing assembly of FIG. 1 with a chute member thereof in an extended position for filling a bucket with ice.

With initial reference to FIG. 1, a side-by-side refrigerator is generally indicated at 2. In a manner widely known in the art, side-by-side refrigerator 2 is formed from a cabinet shell 3 to which is pivotably attached a freezer compartment side door 5 and a fresh food compartment side door 7. In general, the above-described structure of side-by-side refrigerator 2 is known in the art and is provided for the sake of completeness.

Figure 3:
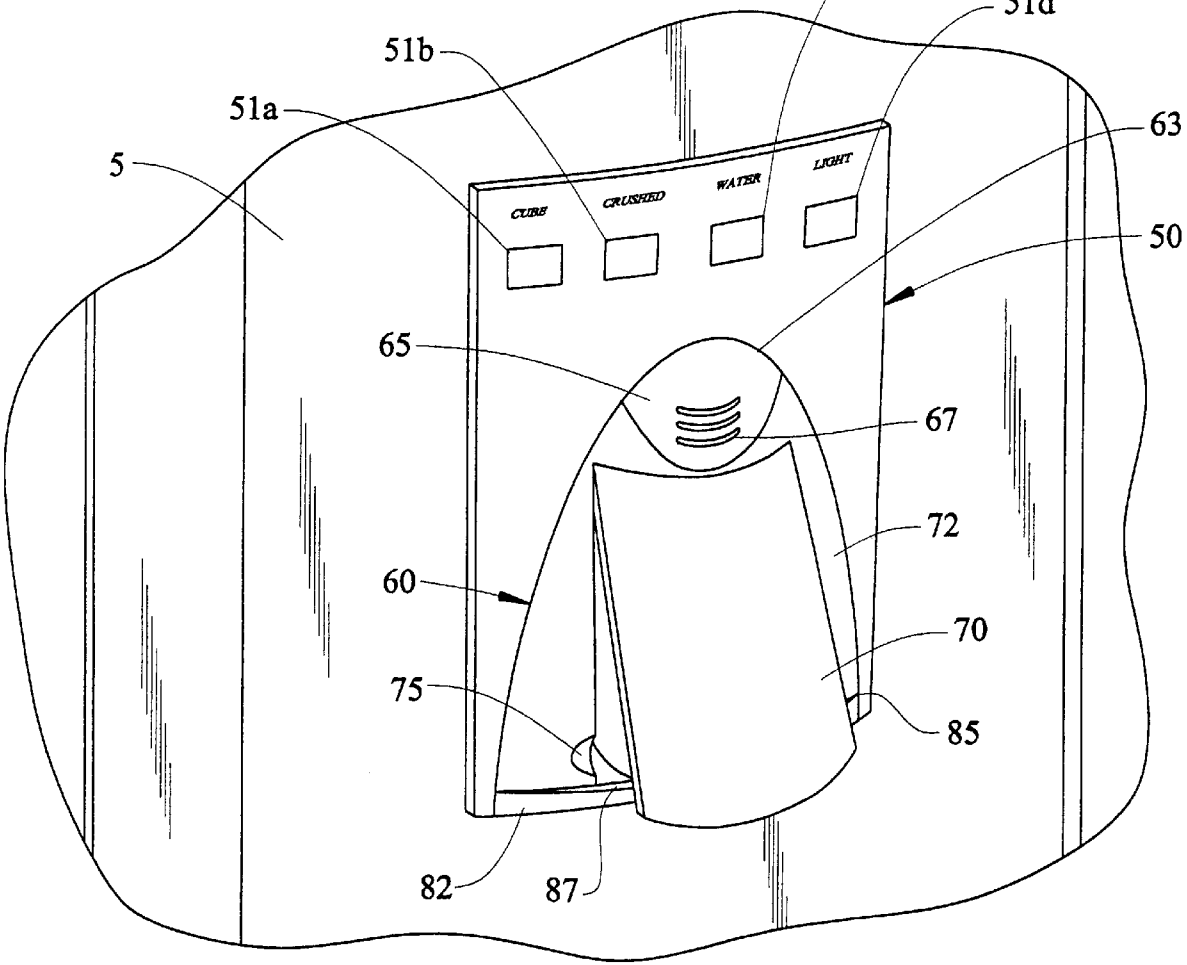
FIG. 3 is an enlarged view of the dispensing assembly of FIG. 1 with the chute member in an extended position.

As also shown in this FIG. 1, freezer compartment side door 5 is provided with a dispensing assembly 50 which can be used to dispense either water or ice as selected through fountain controls as generally indicated at 51. In the embodiment depicted, as best shown in FIG. 3, fountain controls 51 include buttons 51*a* and 51*b* for selecting between crushed and cubed ice respectively, a button 51*c* for selecting the dispensing of water, and a light button 51*d*. It should be understood that an ice maker and ice bin of conventional nature are located in the freezer compartment. In addition, it should be understood that, although not shown, there a conventionally constructed ice passage is provided within freezer door 5 for directing ice from the ice maker to dispensing assembly 50.

Figure 4:
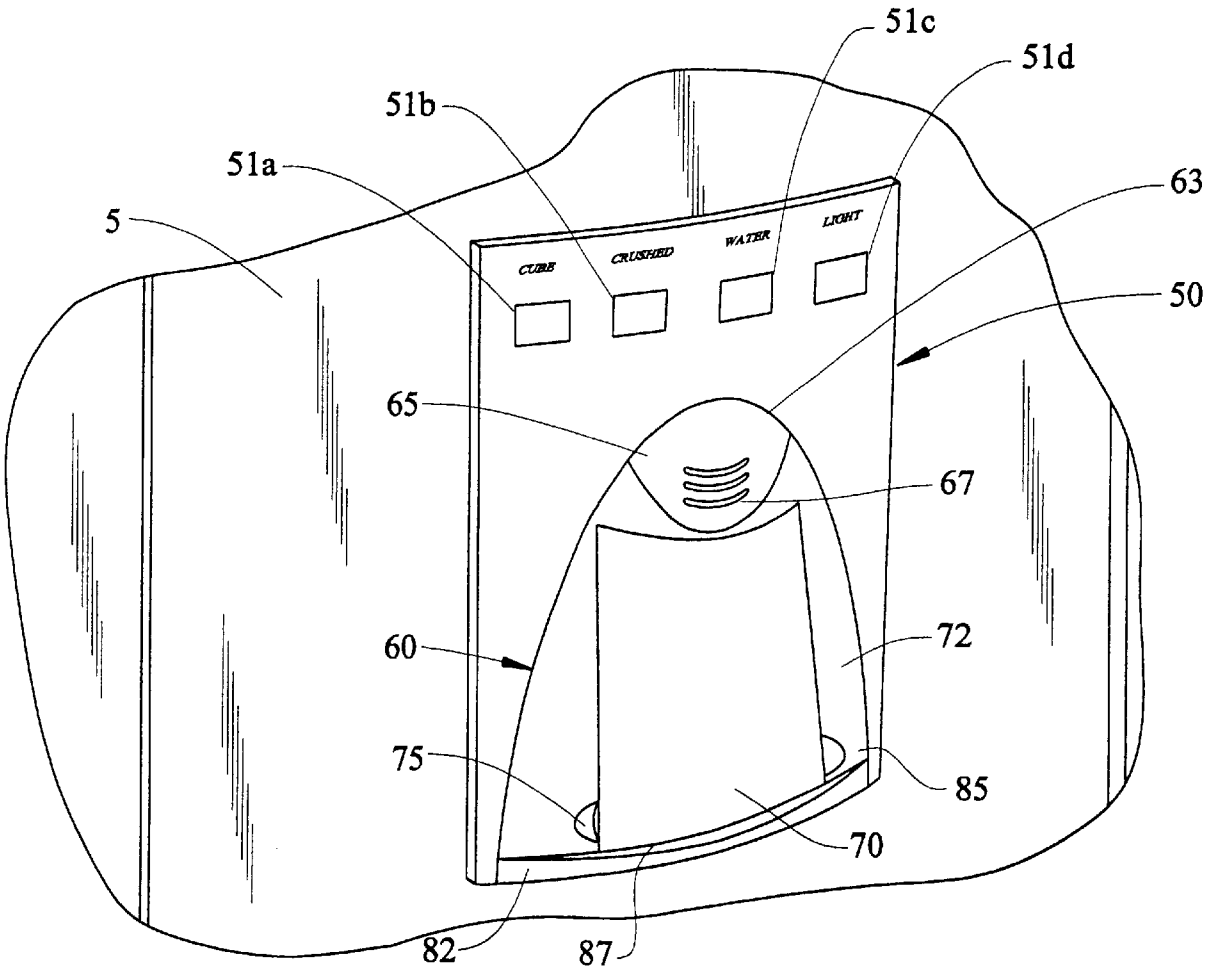
FIG. 4 is an enlarged view of the dispensing assembly of FIG. 1 with the ice chute in a retracted position.
Figure 5:
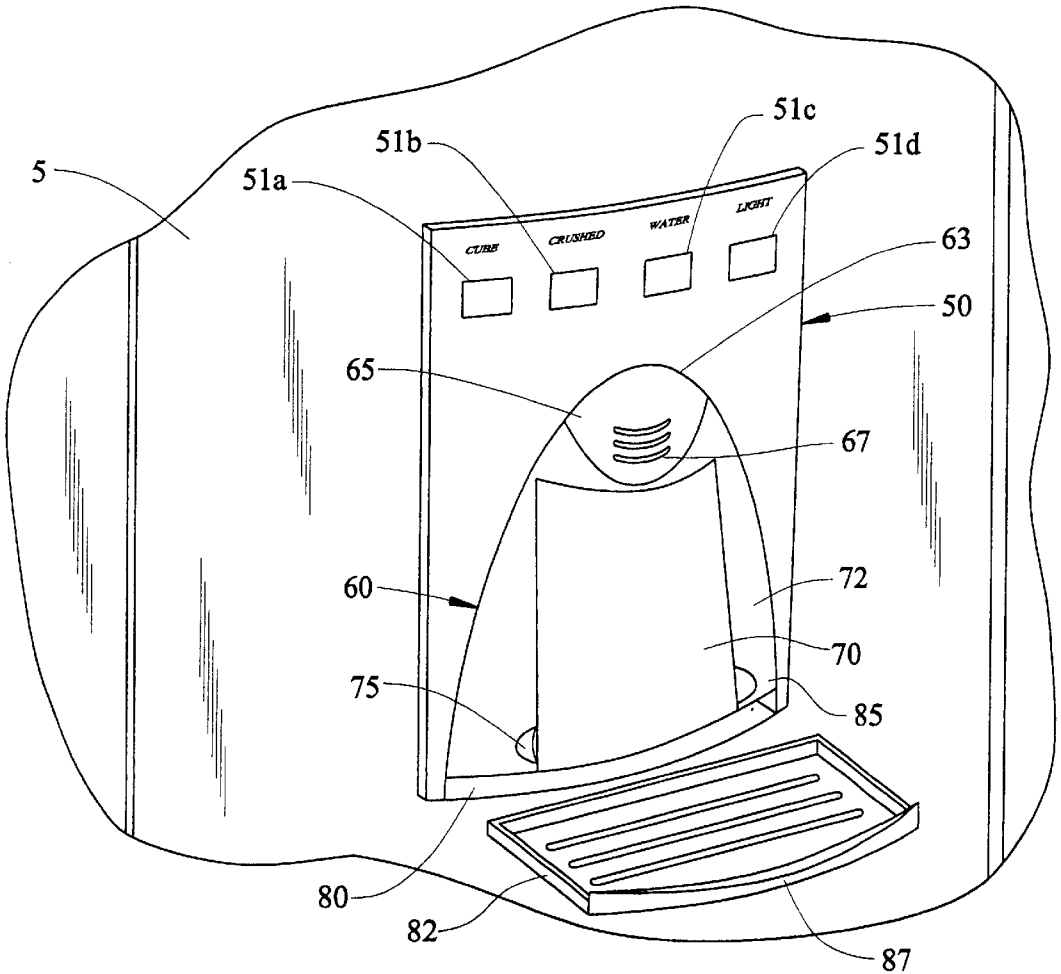
FIG. 5 is an enlarged view of the dispensing assembly of FIG. 1 with an associated drip tray removed from a service zone.

As shown, dispensing assembly 50 includes a service zone 60 which is recessed in an outer portion (not separately labeled) of freezer door 5. At an upper portion 63 of service zone 60, dispensing assembly 50 includes a dispensing actuator pad 65 (see FIGS. 3 and 4) adapted to be displaced by a glass or the like in order to perform a dispensing operation. Dispensing actuator pad 65 includes a plurality of ridges 67 to assist a user in holding a glass or other container in an optimum filling position. Dispensing assembly 50 also includes a chute member 70 which is movable between first and second positions. When chute member 70 is in the first or retracted position, as best shown in FIG. 4, chute member 70 is substantially flush with a fixed, preferably concave wall portion 72 of service zone 60, with fixed wall portion 72 being slightly recessed with respect to the front of freezer door 5. Therefore a user may easily fill a glass with water or ice by engagement with dispensing actuator pad 65 as described above.

When chute member 70 is in the second or extended position, as shown in FIG. 3, chute member 70 projects away from freezer door 5. More specifically, service zone 60 includes finger depressions 75 on opposing sides of and adjacent to chute member 70. With this arrangement, a user can grip chute member 70 at finger depressions 75 in order to manually pivot chute member 70 between the first position shown in FIG. 4 to the second position shown in FIG. 3. Although not specifically shown, chute member 70 preferably, frictionally engages fixed wall portion 72 of service zone 60 in each of the first and second positions. In any case, chute member 70 can be maintained in either of the first and second positions, while being selectively repositioned.

By placing chute member 70 in the second position, a user may direct ice away from freezer door 5 and outside service zone 60. When in the second position, chute member 70 allows a user, for example, to fill an ice bucket 76 without removing the ice bin (not shown) located in the freezer compartment. Further, a slot 80 for receiving a drip tray 82 is located below chute member 70 along a bottom portion 85 of service zone 60. Slot 80 extends the length of service zone 60 and removably receives drip tray 82. Drip tray 82 has a convex front lip 87 which extends slightly beyond recessed service zone 60 for collecting excess water droplets, when drip tray 82 is positioned within slot 80. Drip tray 82 also includes ridges 89 for assisting in water collection and cleanability of drip tray 82.

The recessed nature of service zone 60 and convex front lip 87 of drip tray 82 allow dispensing assembly 50 to be relatively flush with the front panel of freezer door 5, while still providing an area for collecting excess water drops. After dispensing water or ice, excess droplets will drip down chute member 70, when chute member 70 is in the first or retracted position, and collect in drip tray 82 at bottom portion 85 of service zone 60.

Although described with reference to a preferred embodiment of the invention, it should be readily understood that various changes and/or modifications can be made to the invention without departing from the spirit thereof. For instance, although the invention has been described for use in connection with a side-by-side refrigerator, the invention could also be employed in connection with other refrigerator models, including top mount units. In addition, although chute member 70 has been disclosed as being manually movable between the extended and retracted positions, it is possible to provide additional control buttons for activating a motor for use in repositioning chute member 70. Furthermore, instead of being frictionally retained in each of the extended and retracted positions, other configurations may be used, such as biasing chute member 70 to the extended position but selectively retaining chute member 70 in the retracted position. In any case, the invention is only intended to be limited by the scope of the following claims.

I claim:

1. In a refrigerator including freezer and fresh food doors pivotally mounted to a cabinet for selectively accessing respective freezer and fresh food compartments defined within the cabinet, a dispensing assembly for delivering ice pieces from the freezer compartment comprising:

a service zone recessed in an outer portion of one of the fresh food and freezer doors; and a chute member arranged at the service zone, said chute member being movable between a first position, wherein the chute member is arranged to direct ice from within the cabinet into the service zone, and a second position, wherein the chute member is arranged to divert ice away from the one of the fresh food and freezer doors and outside of the service zone.

2. The dispensing assembly according to claim 1, wherein the chute member is mounted for pivotal movement, relative to the one of the fresh food and freezer doors, between the first and second positions.

3. The dispensing assembly according to claim 1, wherein the chute member is mounted for pivotal movement about a pivot axis arranged within the service zone.

4. The dispensing assembly according to claim 1, wherein, in the first position, the chute member is recessed within the service zone and, in the second position, the chute member extends at an angle away from the service zone.

5. The dispensing assembly according to claim 1, further comprising:

an actuating pad arranged above the chute member in the service zone.

6. The dispensing assembly according to claim 1, further comprising:

at least one finger depression formed in the service area adjacent the chute member to assist a user in manually gripping and pivoting the chute member from the first position to the second position.

7. The dispensing assembly according to claim 1, wherein the service zone has a concave configuration relative to the cabinet.

8. The dispensing assembly according to claim 7, wherein the chute member is generally concave so as to conform to the concave configuration of the service zone.

9. The dispensing assembly according to claim 1, further comprising:

a drip tray positioned adjacent a bottom edge of the chute member.

10. The dispensing assembly according to claim 9, wherein the drip tray is substantially hidden from a front of the cabinet.

11. A method of dispensing ice through a door of a refrigerator comprising:

repositioning a chute member from a first position, wherein the chute member is arranged entirely within a service zone recessed in an outer portion of the door, to a second position, wherein the chute member projects, at least partially, out of the service zone;

causing a flow of ice to be directed along the chute member to a position outside of the service zone; and collecting the ice in a container located in front of the door.

12. The method of claim 11, further comprising: pivotally shifting the chute member between the first and second positions.

13. The method of claim 12, further comprising: manually pivoting the chute member between the first and second positions.

14. The method of claim 13, further comprising: engaging finger depressions adjacent to the chute member to assist in pivoting the chute member to the second position.

15. The method of claim 11, further comprising:

positioning the chute member in the first position; and dispensing water into the container.

16. The method of claim 15, further comprising: collecting excess water droplets within a drip tray arranged adjacent a bottom edge of the chute member.

17. The method of claim 16, further comprising: slidably removing the drip tray from a substantially hidden position within the service zone.

* * * * *